US006808598B1

(12) United States Patent
Takeuchi et al.

(10) Patent No.: US 6,808,598 B1
(45) **Date of Patent: *Oct. 26, 2004**

(54) WATER-DECOMPOSABLE FIBROUS SHEET CONTAINING GEL COMPOUND

(75) Inventors: Naohito Takeuchi, Kagawa (JP); Takayoshi Konishi, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 53 days.

This patent is subject to a terminal disclaimer.

(21) Appl. No.: 09/675,890

(22) Filed: Sep. 29, 2000

(30) Foreign Application Priority Data

Oct. 5, 1999 (JP) ..... 11-284036

(51) Int. Cl.[7] ..... D21H 13/08

(52) U.S. Cl. ..... 162/115; 442/408; 442/409; 442/414; 162/157.6; 162/157.7; 162/158; 162/181.6; 162/181.7; 428/311.31

(58) Field of Search ..... 442/414, 408, 442/409; 162/155, 115, 157.6, 157.7, 181.6, 181.7; 428/311.31

(56) References Cited

U.S. PATENT DOCUMENTS

| | | | | | |
|---|---|---|---|---|---|
| 2,399,981 | A | * | 5/1946 | Britt | 162/181.7 |
| 2,801,938 | A | * | 8/1957 | Iler | 428/538 |
| 4,608,361 | A | * | 8/1986 | Kanamori et al. | 502/232 |
| 6,287,419 | B1 | * | 9/2001 | Takeuchi et al. | 162/115 |

FOREIGN PATENT DOCUMENTS

| | | |
|---|---|---|
| JP | 01168999 | 7/1989 |
| JP | 2149237 | 6/1990 |
| JP | 09132896 | 5/1997 |
| JP | 09132897 | 5/1997 |
| JP | 09-217293 | 8/1997 |
| JP | 011187983 | 7/1999 |

* cited by examiner

*Primary Examiner*—Cheryl A. Juska
(74) *Attorney, Agent, or Firm*—Darby & Darby

(57) ABSTRACT

Herein provided is a water-decomposable fibrous sheet includes water-dispersible fibers having a fiber length of at most 20 mm, and a gel compound.

14 Claims, No Drawings

WATER-DECOMPOSABLE FIBROUS SHEET CONTAINING GEL COMPOUND

BACKGROUND OF THE INVENTION

1. Field of the Invention

The present invention relates to a water-decomposable fibrous sheet capable of being readily decomposed and dispersed in water flow. More precisely, it relates to such a water-decomposable fibrous sheet of which the decomposability in water measured in wet, the strength at break measured in dry, and the strength at break measured in wet are all good.

2. Description of the Related Art

To wipe the skin of human bodies including the private parts thereof, or to clean toilets and thereabouts, the fibrous sheet are used as wiper sheets. The strength of the wiper sheets must be enough for wiper applications. For easy and effective use, many such wiper sheets are wetted with a detergent chemical or the like previous to being used. Therefore, the wiper sheets must have high strength in wet to such a degree that they are well fit for wiping with them wetted with such a detergent chemical or the like.

On the other hand, this type of the sheets are preferably decomposable in water in order that they could be directly disposed of in toilets after their use. This is because, if poorly water-decomposable sheets are disposed of in toilets after their use, they will take a lot of time until they are decomposed and dispersed in septic tanks, or will clog the drainpipes around toilets, etc.

Accordingly, the sheets to be used in wet with a detergent chemical or the like infiltrated thereinto must satisfy the two contradictory requirements, one being that they must have high strength in wet with a detergent chemical or the like infiltrated thereinto to such a degree that they are well fit for wiper applications, and the other being that they must be decomposable in water after disposed of in toilets. However, it is extremely difficult to produce sheets having well-balanced decomposability in water and strength.

For increasing the wet strength of fibrous sheets without lowering the decomposability in water thereof, a binder for binding the constituent fibers to each other and also various compounds for enhancing the effect of the binder are added to the sheets. For example, Japanese Unexamined Patent Publication (Kokai) No. Heisei 2-149237 discloses a water-decomposable cleaning article made of water-decomposable paper that contains a carboxyl group-having water-soluble binder, in which an alkaline earth metal such as manganese and zinc is infiltrated into the water-decomposable paper along with an organic solvent. Japanese Unexamined Patent Publication (Kokai) Nos. Heisei 9-132896 and 9-132897 disclose water-decomposable sheets which contain water-insoluble or water-swellable carboxymethyl cellulose serving as a binder, along with sodium carbonate added thereto. Japanese Unexamined Patent Publication (Kokai) No. Heisei 11-187983 discloses a water-decomposable fibrous sheet which contains an alkyl cellulose serving as a binder, along with a copolymer, an amino acid derivative and an electrolyte. However, the fibrous sheets disclosed therein have some problems. They are often sticky if containing a large amount of such a binder. They shall contain a large amount of a metallic compound serving as an electrolyte in order that the binder therein is salted out to increase the wet strength of the sheets. Using the sheets having such a large metal content for wiping the skin is unfavorable.

Japanese Unexamined Patent Publication (Kokai) No. Heisei 1-168999 discloses a water-dispersible cleaning article made of easily water-dispersible paper prepared from a mixture of from 60 to 99% by mass of water-dispersible fibers for paper and from 1 to 40% by mass of water-insoluble carboxymethylated pulp, wherein the paper carries an active material-containing organic compound applied thereto. However, a large amount of the active material-containing organic compound (e.g., mono- or polyalcohols, oils and fats, etc.) is infiltrated into the cleaning article in order to increase the wet strength of the article. If containing a large amount of a skin-irritating compound such as alcohol or the like, sheets could not be used for wiping the private parts of babies and infants. Furthermore, if containing a large amount of an organic solvent, the sheets will damage resin objects.

SUMMARY OF THE INVENTION

One object of the present invention is to provide a fibrous sheet capable of readily decomposing in water and having good dry strength and wet strength.

Another object of the invention is to provide such a water-decomposable fibrous sheet for various wiper applications, for example, for wiping the private parts of human bodies and for cleaning resin objects.

Still another object is to provide such a water-decomposable fibrous sheet comfortably usable with no sticky feel.

According to an aspect of the invention, a water-decomposable fibrous sheet may comprise water-dispersible fibers having a fiber length of at most 20 mm and a gel compound. Though having high strength at break both in dry and in wet, the water-decomposable fibrous sheet of the invention well decomposes in water when in wet.

Preferably, the gel compound is formed from colloidal particulates and an electrolyte. More preferably, the colloidal particulates are colloidal silica. Still preferably, the colloidal silica content of the sheet falls between 0.25 g and 25 g in terms of silicic acid anhydride, relative to 100 g of the fibers constituting the sheet. Still preferably, the sheet contains an aqueous solution infiltrated thereinto and the aqueous solution contains at least 0.2% by mass of the electrolyte.

Also preferably, the sheet further contains a binder for binding the fibers to each other. More preferably, the binder is at least one compound selected from a group consisting of alkyl celluloses, carboxymethyl cellulose, polyvinyl alcohol, modified polyvinyl alcohols, sodium polyacrylate, sodium alginate, polyethylene oxide, starch, and modified starches.

Preferably, the sheet is so constructed that a layer containing the binder and the colloidal silica is formed on the surface of a fibrous layer of the water-dispersible fibers. Also preferably, it is so constructed that a layer of the binder is formed on the surface of the fibrous layer of the water-dispersible fibers containing the colloidal silica. Also preferably, the sheet contains the colloidal silica and the binder in the fibrous layer of the water-dispersible fibers.

Preferably, the fibrous layer is of a water-decomposable non-woven fabric having been subjected to water-jetting treatment. Also preferably, the fibrous layer is of a water-decomposable paper having been prepared in a paper-making process.

Preferably, a weight of the fibers constituting the sheet falls from 30 to 80 g/m$^2$.

Also preferably, the sheet has a degree of decomposition in water of at most 200 seconds measured in wet according to JIS P-4501, a strength at break in dry of at least 1400 g/25 mm, and a strength at break in wet of at least 150 g/25 mm.

DESCRIPTION OF THE PREFERRED EMBODIMENTS

The water-decomposable fibrous sheet of the invention will be described in detail hereinunder.

The water-dispersible fibers constituting the sheet of the invention are meant to indicate fibers well dispersible in water. The dispersibility in water referred to herein has the same meaning as the decomposability in water, and is meant to indicate that the fibers constituting the sheet are decomposed and dispersed well in water when kept in contact with a large amount of water.

The fibers constituting the sheet of the invention may be any of natural fibers and/or chemical fibers. The natural fibers include those from wood pulp such as soft wood pulp, hard wood pulp, etc.; and also those from Manila hemp, linter pulp, etc. The chemical fibers include regenerated fibers of rayon and fibrillated rayon; synthetic fibers of polypropylene, polyvinyl alcohol, polyester, polyacrylonitrile, etc. Among those, preferred are pulp and rayon, as being well dispersible in water. Further usable herein are biodegradable fibers of polylactic acid, polycaprolactone, aliphatic polyesters such as polybutylene succinate, polyvinyl alcohol, collagen, etc. Needless to say, any fibers other than those mentioned above are usable herein so far as they are dispersible in water.

The fiber length of the water-dispersible fibers is at most 20 mm for the decomposability in water of the fibrous sheet comprising the fibers. Preferably, it falls between 2 mm and 10 mm. The fiber length referred to herein indicates the mean fiber length of the fibers. In case where rayon is used for the water-dispersible fibers, its fineness preferably falls between 1.0 and 3.0 deniers (between 1.1 and 3.3 dtex).

The gel compound for use in the invention is in the form of a gel. When added to the fibrous sheet, it fulfills the function of increasing the sheet strength. The gel compound may be a gel of colloidal particulates including, for example, colloidal silica, colloidal alumina, colloidal zirconia, platinum colloid, iron hydroxide colloid, colloidal graphite, silver colloid, gold colloid, etc. Among those, preferred is colloidal silica as being highly safe to human bodies and inexpensive. Colloidal silica is a colloid dispersion of ultrafine particulates of silicic acid anhydride dispersed in water. Silicic acid anhydride may have a particle size of from 0.007 to 0.05 $\mu$m, for example. In general, colloidal silica contains from 20 to 40% by mass of silicic acid anhydride.

Colloidal silica is readily gelled with metal ions added thereto, especially with polyvalent metal ions. Gelation of colloidal silica is caused by electric instability thereof with an electrolyte added thereto. Therefore, as is the case with the salting-out reaction, the electrolyte concentration in the gel of colloidal silica is lowered when the gel is contacted with a large amount of water, and the bonding force of the gel is thereby lowered. Accordingly, colloidal silica existing in the fibrous sheet of the invention can increase the strength of the sheet with little influence on the decomposability of the sheet in water.

In order to increase the strength of the fibrous sheet, the colloidal silica content of the sheet is preferably at least 0.1 g in terms of silicic acid anhydride therein, per 1 $m^2$ of the sheet. Also preferably, the colloidal silica content of the sheet falls between 0.25 g and 25 g in terms of silicic acid anhydride therein, relative to 100 g of the fibers constituting the sheet. If the colloidal silica content is larger than the uppermost limit set froth above, the decomposability in water of the sheet will be low.

For gelling colloidal silica, any electrolyte may be used. For example, the electrolyte for that purpose may be at least one compound selected from a group consisting of sodium sulfate, potassium sulfate, zinc sulfate, aluminium sulfate, alum, sodium chloride, calcium chloride, magnesium sulfate, zinc nitrate, potassium chloride, sodium carbonate, sodium hydrogencarbonate, ammonium carbonate, sodium citrate, sodium pyrrolidonecarboxylate, potassium citrate, sodium tartrate, potassium tartrate, sodium lactate, sodium succinate, sodium pantothenate, calcium lactate, and sodium laurylsulfate.

The electrolyte is dissolved in water, and the resulting aqueous solution is infiltrated into the sheet. In this case, the electrolyte concentration necessary for gelling colloidal silica is at least 0.2% by mass. This concentration may be lower than the electrolyte concentration in conventional water-decomposable fibrous sheets with a water-soluble binder therein, for making the binder undergo salting-out reaction or crosslinking reaction.

From the fibers and the gel compound mentioned above, the fibrous sheet of the invention is formed. For example, fibers and a gelling compound are mixed, and formed into a sheet according to a paper-making process or through water-jetting treatment. As the case may be, fibers are firstly formed into a fibrous layer according to a paper-making process or through water-jetting treatment, and a gelling compound is applied onto the surface of the fibrous layer to finish a sheet. For gelling the gelling compound, an aqueous solution of an electrolyte is infiltrated into the sheet. The water-decomposable fibrous sheet of the invention thus produced has a high wet strength, and, when brought into contact with a large amount of water, the bonding force of the gel therein is lowered, so that the sheet is readily decomposed in water.

Preferably, the weight (Metsuke) of the fibers constituting the fibrous sheet of the invention falls between 30 and 80 g/$m^2$. If its weight is smaller than the lowermost limit of the defined range, the sheet could not have the necessary strength for wiper applications. If, however, its weight is larger than the uppermost limit of the defined range, the sheet will be not flexible. In particular, in case where the sheet is used for wiping the private parts of human bodies or for cleaning easily scratching objects, its weight is more preferably from 40 to 60 g/$m^2$, in view of the strength and the soft feel of the sheet.

In order to further increase its wet strength, the water-decomposable fibrous sheet of the invention preferably contains a binder along with the gel compound. Any and every binder may be used in the sheet. For example, the binder is preferably at least one compound selected from a group consisting of alkyl celluloses, water-soluble, water-swellable, or water-insoluble carboxymethyl cellulose, polyvinyl alcohol, modified polyvinyl alcohols, sodium polyacrylate, sodium alginate, polyethylene oxide, starch, and modified starches.

Alkyl celluloses referred to herein are cellulose derivatives prepared by substituting the hydroxyl groups in the glucose ring units of cellulose with alkyl groups. They may include, for example, methyl cellulose, ethyl cellulose, benzyl cellulose, etc. Among those, especially preferred is methyl cellulose as being more effective for enhancing the decomposability in water of the sheet and for increasing the strength thereof. On the other hand, modified polyvinyl alcohols are vinyl alcohol-based polymers containing a predetermined amount of sulfonic acid groups or carboxyl groups.

The amount of the binder to be added (or to be applied) to the sheet is preferably from 0.5 g to 20 g relative to 100 g of the mass of the fibers constituting the sheet. If the amount thereof is smaller than the lowermost limit of the defined range, the wet strength of the fibrous sheet will be low. However, if the amount is larger than the uppermost limit of the defined range, the fibrous sheet will be sticky and hard, thereby losing a soft feel in use. If so, in addition, the decomposability in water of the sheet will be poor.

Some concrete examples of producing the water-decomposable fibrous sheet of the invention that contains water-dispersible fibers, a gel compound and a binder are mentioned below.

(1) Water-dispersible fibers are made into water-decomposable paper according to a paper-making process; or a web made of water-dispersible fibers is subjected to water-jetting treatment to give a water-decomposable non-woven fabric. A binder and a gelling compound are applied onto the water-decomposable paper or the water-decomposable non-woven fabric. Next, an aqueous solution of an electrolyte is infiltrated into the resulting sheet. Accordingly, the thus-produced fibrous sheet is so constituted that a layer containing a binder and a gel compound is formed on the surface of the layer of water-dispersible fibers.

(2) Water-dispersible fibers and a gelling compound are mixed and made into water-decomposable paper according to a paper-making process; or a web made of a mixture of water-dispersible fibers and a gelling compound is subjected to water-jetting treatment to give a water-decomposable non-woven fabric. A binder is applied onto the water-decomposable paper or the water-decomposable non-woven fabric through a silk screen or the like, for example. Next, an aqueous solution of an electrolyte is infiltrated into the resulting sheet. Accordingly, the thus-produced fibrous sheet is so constituted that a binder layer is formed on the surface of the fibrous layer comprising water-dispersible fibers and containing a gel compound.

(3) Water-dispersible fibers, a gelling compound and a binder are mixed and made into water-decomposable paper according to a paper-making process; or a web made of a mixture of water-dispersible fibers, a gelling compound and a binder is subjected to water-jetting treatment to give a water-decomposable non-woven fabric. Next, an aqueous solution of an electrolyte is infiltrated into the resulting sheet. Accordingly, the fibrous layer of the thus-produced sheet contains a gel compound and a binder.

The water-jetting treatment will be described in detail. The fibrous web formed in the manner as above is put on a continuously moving, meshed conveyor belt, and exposed to high-pressure water-jetting streams to such a degree that the streams applied thereto could pass through from a top surface to a back surface of the fibrous web. Through the water-jetting treatment, the properties of the resulting non-woven fabric are changed, depending on the weight of the fibrous web to be processed, the pore diameter of the jetting nozzles to be used, the number of the pores of the jetting nozzles, the speed at which the fibrous web is processed with the water-jetting streams (processing speed) or the like. For example, when the work load to be derived from the following formula:

$$\text{Work load (kW/m}^2\text{)}=\{1.63\times\text{jetting pressure (kg/cm)}\times\text{jetting flow rate (m}^3\text{/min)}\}\div\text{processing speed (m/min)},$$

is from 0.04 to 0.5 (kW/m$^2$) in one treatment for one surface of the fibrous web, it is desirable that the water-jetting treatment is effected once or repeated 2 to 6 times to obtain a favorable non-woven fabric. However, in case where the processing conditions are changed variously, favorable non-woven fabrics could be obtained even though the work load does not fall within the preferred range set forth above.

The fibrous sheet of the invention that comprises such a water-decomposable non-woven fabric having been subjected to water-jetting treatment is bulky and soft; thereby being favorable to wiper applications. For example, the thickness of the fibrous sheet having been subjected to water-jetting treatment is preferably at least 0.4 mm.

The fibrous sheet of the invention is suitable for wiper applications both in dry and in wet condition. For wiper applications, however, it is desirable that the fibrous sheet has a dry strength at break of at least 1400 g/25 mm, and a wet strength at break of at least 150 g/25 mm. Also preferably, the decomposability in water of the fibrous sheet, measured in wet according to JIS P-4501, is at most 300 seconds, in order that the sheet ensures the strength as above and can be readily decomposed in water, when disposed of in toilets and others and when brought into contact with a large amount of water therein. More preferably, the decomposability in water of the fibrous sheet is at most 200 seconds, even more preferably at most 100 seconds. However, so far as its decomposability in water is at most 250 seconds or so, the sheet can be well disposed of in flush toilets with no problem.

In case where the fibrous sheet of the invention contains an alkyl cellulose serving as a binder, it may contain some additional compounds for further increasing the wet strength of the fibrous sheet. For example, the fibrous sheet may additionally contain a copolymer of a copolymerizable acid anhydride compound such as (meth)acrylic acid-maleic acid resin, (meth)acrylic acid-fumaric acid resin or the like, with a compound copolymerizable with the acid anhydride compound. Preferably, the copolymer is saponified with sodium hydroxide or the like to have a partially saponified sodium carboxylate moiety. Also preferably, the fibrous sheet may contain an amino acid derivative such as trimethylglycine, etc.

In addition, the fibrous sheet of the invention may contain any other compounds not interfering with the effect of the invention. For example, it may contain any of surfactants, bactericides, preservatives, deodorants, moisturizers, alcohols, etc. It may also contain an organic solvent for enhancing the wiping capability of the sheet. In this case, however, it is desirable that the organic solvent in the sheet does not have any negative influences on the skin and plastic objects. The organic solvent may include monoalcohols such as ethanol, isopropyl alcohol, propylene glycol monomethyl ether, etc.; polyalcohols such as propylene glycol, polyethylene glycol, etc.

The water-decomposable fibrous sheet of the invention can be used as wet tissue for wiping the skin of human bodies including the private parts thereof, and for cleaning toilets and thereabouts.

If desired, water and optionally any other compounds such as those mentioned above may be infiltrated into the water-decomposable fibrous sheet of the invention, before the sheet is packaged. In case where the sheet is wetted and packaged for public sale, it shall be airtightly packaged and put on the market so that it is not spontaneously dried. On the other hand, the sheet may be marketed in dry. The users may wet it with water and optionally any other compounds such as those mentioned above, before use. The dry fibrous sheet which shall be used still in dry is prepared by adding (or applying) colloidal silica and an electrolyte, then gelling the colloidal silica with the electrolyte in the sheet, and finally drying the sheet.

EXAMPLES

The invention will be described hereinafter in more detail with reference to the following Examples, which, however, are not intended to restrict the scope of the invention.

Example A

Raw fibers of bleached soft-wood kraft pulp (NBKP, having a degree of beating of 550 cc in Canadian Standard Freeness Test (CSF)) and rayon (fiber length 5 mm, 1.7 dtex) were mixed and formed into a fibrous web, which was then subjected to water-jetting treatment to be a water-decomposable non-woven fabric. In this case, the blend ratio of NBKP to rayon was 50:50% by mass. Regarding the condition for the water-jetting treatment, the nozzle diameter was 95 $\mu$m, the nozzle pitch was 0.7 mm, and the work load was 0.17514 KW/m$^2$.

A mixture of colloidal silica (Snowtex S (trade name) manufactured by Nissan Chemical, having a silicic acid anhydride content of from 30 to 31% by mass and having a particle size of from 7 to 9 nm) and methyl cellulose serving as a binder was applied onto the surface of the resulting, water-decomposable non-woven fabric, and dried thereon. Next, a liquid chemical was infiltrated into the fabric to prepare a water-decomposable fibrous sheet of the invention, in which the amount of the liquid chemical was 250% by mass relative to the mass of the sheet. To each sample of this Example, the amount of colloidal silica to be added is indicated in terms of the amount of silicic acid anhydride therein. The amount of colloidal silica varies in each sample. The liquid chemical applied to the sheet is an aqueous solution containing 2% by mass of sodium sulfate, 4% by mass of trimethylglycine, and 10% by mass of propylene glycol. The decomposability in water of each sample in wet and the wet strength thereof were measured. The Details are as Follows:

Decomposability in Water:

The test for the decomposability in water of each sample was based on the test of JIS P-4501 indicating the degree of degradability of toilet paper. Precisely, the sample to be tested was cut into pieces each having a length of 10 cm and a width of 10 cm, and one piece was put into a beaker filled with 300 ml of ion-exchanged water, and stirred therein with a rotor. The revolution speed of the rotor was 600 rpm. The condition of the test piece being dispersed in water was macroscopically observed at predetermined time intervals, and the time until the test piece was finely dispersed was measured (see the following Table—the data are expressed in seconds).

Wet Strength:

The wet strength of each sample was measured as follows. The sample to be tested was cut into pieces each having a width of 25 mm and a length of 150 mm, and the pieces were tested both in the machine direction (MD) and in the cross direction (CD), by use of a Tensilon tester, of which the chuck distance was 100 mm and the stress rate was 100 mm/min. From the data obtained, the strength of the sample was calculated according to the following formula;

$$\text{Wet Strength}=\sqrt{(\text{strength (gf) at break in MD}\times\text{strength (gf) at break in CD})}$$

The value thus obtained indicates the wet strength of the sample tested (see the following Table—the data are expressed in g/25 mm).

With comparative Examples, fibrous sheets not containing colloidal silica were prepared in the same manner as in Examples, and their decomposability in water and wet strength were measured also in the same manner as herein. The test results obtained are given in Table 1.

TABLE 1

| | | Comparative Example 1 | Comparative Example 2 | Example A-1 | Example A-2 | Example A-3 | Example A-4 | Example A-5 |
|---|---|---|---|---|---|---|---|---|
| Amount Of Methyl Cellulose Applied | g/m$^2$ | 0.0 | 4.0 | 4.0 | 4.0 | 4.0 | 4.0 | 4.0 |
| Amount of Colloidal Silica Added | g/m$^2$ | 0.0 | 0.0 | 0.1 | 0.8 | 3.0 | 7.0 | 10.0 |
| Wet Strength | g/25 mm | 53 | 142 | 151 | 193 | 255 | 456 | 633 |
| Decomposability in Water | Sec | 44 | 50 | 50 | 52 | 65 | 85 | 250 |

Example B

Water-decomposable fibrous sheets were prepared in the same manner as in Example A. In this case, however, the type of the electrolyte in the liquid chemical to be infiltrated into these sheets was varied. The fibrous sheets thus obtained herein were tested in the same manner as in Example A for the decomposability in water and the wet strength.

With comparative Examples, fibrous sheets not containing colloidal silica were prepared in the same manner as in Examples, and their decomposability in water and wet strength were measured also in the same manner as herein. The test results obtained are given in Table 2.

TABLE 2

| | | Comparative Example 1 | Comparative Example 2 | Comparatie Example 3 | Example B-1 | Example B-2 | Example B-3 |
|---|---|---|---|---|---|---|---|
| Amount of Methyl Cellulose Applied | g/m$^2$ | 4.0 | 4.0 | 4.0 | 4.0 | 4.0 | 4.0 |

TABLE 2-continued

| | | Comparative Example 1 | Comparative Example 2 | Comparatie Example 3 | Example B-1 | Example B-2 | Example B-3 |
|---|---|---|---|---|---|---|---|
| Amount of Colloidal Silica Added | $g/m^2$ | 0.0 | 0.0 | 0.0 | 1.5 | 1.5 | 1.5 |
| Type of Electrolyte | | sodium sulfate | zinc sulfate | Aluminium sulfate | sodium sulfate | zinc sulfate | aluminium sulfate |
| Wet Strength | g/25 mm | 142 | 90 | 93 | 202 | 147 | 163 |
| Decomposability in Water | sec | 50 | 41 | 43 | 53 | 55 | 61 |

Example C

Water-decomposable fibrous sheets were prepared in the same manner as in Example A. In this case, however, the pH and the particle size of colloidal silica added to these sheets were varied. The fibrous sheets thus obtained herein were tested in the same manner as in Example A for the decomposability in water and the wet strength. The test results obtained are given in Table 3.

TABLE 3

| | | Comparative Example 1 | Example C-1 | Example C-2 | Example C-3 | Example C-4 |
|---|---|---|---|---|---|---|
| Amount of Methyl Cellulose Applied | $g/m^2$ | 4.0 | 4.0 | 4.0 | 4.0 | 4.0 |
| Amount of Colloidal Silica Added | $g/m^2$ | 0.0 | 1.5 | 1.5 | 1.5 | 1.5 |
| Particle Size of Colloidal Silica | nm | — | 10–20 | 10–20 | 10–20 | 7–9 |
| pH of Colloidal Silica | | — | 9.5–10 | 9.0–10 | 2–4 | 9.0–10.5 |
| Wet Strength | g/25 mm | 142 | 214 | 251 | 250 | 202 |
| Decomposability in Water | sec | 50 | 52 | 51 | 53 | 53 |

The fibrous sheet of the invention is well decomposable in water and has good dry strength and wet strength.

Being different from the conventional water-decomposable fibrous sheets, the fibrous sheet of the invention requires neither a large amount of an electrolyte for salting out a binder nor a large amount of an organic solvent. Accordingly, the fibrous sheet of the invention has many applications for wiping the private parts of human bodies and for cleaning resin objects or the like.

Also different from the conventional water-decomposable fibrous sheets, the fibrous sheet of the invention has high wet strength even though the amount of the binder to be added thereto is reduced. Accordingly, the fibrous sheet of the invention is not sticky and can be used comfortably.

While the invention has been described in detail and with reference to specific embodiments thereof, it will be apparent to one skilled in the art that various changes and modifications can be made therein without departing from the spirit and scope thereof.

Here, 'comprises/comprising' when used in this specification is taken to specify the presence of stated features, integers, steps or components but does not preclude the presence or addition of one or more other features, integers, steps, components or groups thereof.

What is claimed is:

1. A water-decomposable fibrous sheet in which an aqueous solution is infiltrated, comprising:

water-dispersible fibers having a fiber length of at most 20 mm; and colloidal silica gelled with an electrolyte contained in the aqueous solution, wherein a content of the colloidal silica is from 0.25 g to 25 g in terms of silicic acid anhydride, relative to 100 g of the fibers, and a concentration of the electrolyte is at least 0.2% by mass, wherein the electrolyte is at least one compound selected from the group consisting of sodium sulfate, potassium sulfate, zinc sulfate, aluminum sulfate, alum, sodium chloride, calcium chloride, magnesium sulfate, zinc nitrate, potassium chloride, sodium carbonate, sodium hydrogencarbonate, ammonium carbonate, sodium citrate, sodium pyrrolidonecarboxylate, potassium citrate, sodium tartrate, potassium tartrate, sodium lactate, sodium succinate, sodium pantothenate, calcium lactate, and sodium laurylsulfate.

2. The water-decomposable fibrous sheet as set forth in claim 1, which further contains a binder for binding the fibers to each other.

3. The water-decomposable fibrous sheet as set forth in claim 2, wherein the binder is at least one compound selected from a group consisting of alkyl celluloses, carboxymethyl cellulose, polyvinyl alcohol, modified polyvinyl alcohols, sodium polyacrylate, sodium alginate, polyethylene oxide, starch, and modified starches.

4. The water-decomposable fibrous sheet as set forth in claim 2, wherein a layer containing the binder and the colloidal silica is formed on the surface of a fibrous layer of the water-dispersible fibers.

5. The water-decomposable fibrous sheet as set forth in claim 4, wherein the fibrous layer is of a water-decomposable non-woven fabric having been subjected to water-jetting treatment.

6. The water-decomposable fibrous sheet as set forth in claim 4, wherein the fibrous layer is of a water-decomposable paper having been prepared in a paper-making process.

7. The water-decomposable fibrous sheet as set forth in claim 2, wherein a layer of the binder is formed on the surface of a fibrous layer of the water-dispersible fibers containing the colloidal silica.

8. The water-decomposable fibrous sheet as set forth in claim 7, wherein the fibrous layer is of a water-decomposable non-woven fabric having been subjected to water-jetting treatment.

9. The water-decomposable fibrous sheet as set forth in claim 7, wherein the fibrous layer is of a water-decomposable paper having been prepared in a paper-making process.

10. The water-decomposable fibrous sheet as set forth in claim 2, which contains the colloidal silica and the binder in a fibrous layer of the water-dispersible fibers.

11. The water-decomposable fibrous sheet as set forth in claim 10, wherein the fibrous layer is of a water-decomposable non-woven fabric having been subjected to water-jetting treatment.

12. The water-decomposable fibrous sheet as set forth in claim 10, wherein the fibrous layer is of a water-decomposable paper having been prepared in a paper-making process.

13. The water-decomposable fibrous sheet as set forth in claim 1, wherein a weight of the fibers is between a range of 30 to 80 $g/m^2$.

14. The water-decomposable fibrous sheet as set forth in claim 1, which has a degree of decomposition in water of at most 200 seconds measured in wet according to JIS P-4501, a strength at break in dry of at least 1400 g/25 mm, and a strength at break in wet of at least 150 g/25 mm.

* * * * *